US005863259A

United States Patent [19]

Sacco

[11] Patent Number: 5,863,259

[45] Date of Patent: Jan. 26, 1999

[54] ADVANCED TOP PLANE FOR STANDARD IRON

[75] Inventor: Thomas Sacco, Longwood, Fla.

[73] Assignee: Thomas Golf, Inc., Longwood, Fla.

[21] Appl. No.: 919,068

[22] Filed: Aug. 22, 1997

[51] Int. Cl.[6] ..... A63B 53/04

[52] U.S. Cl. ..... 473/290; 473/350

[58] Field of Search ..... 473/252, 350, 473/290, 324, 342, 349

[56] References Cited

U.S. PATENT DOCUMENTS

| | | | |
|---|---|---|---|
| 3,814,437 | 6/1974 | Winquist | 473/350 |
| 3,880,430 | 4/1975 | McCabe | 473/253 |
| 4,900,028 | 2/1990 | Antonious | 473/242 |
| 4,938,470 | 7/1990 | Antonious | 473/242 |
| 5,011,151 | 4/1991 | Antonious | 473/242 |
| 5,104,457 | 4/1992 | Viljoen | 473/350 |
| 5,429,366 | 7/1995 | McCabe | 473/244 |
| 5,716,288 | 2/1998 | Sacco | 473/290 |

*Primary Examiner*—Steven Wong
*Assistant Examiner*—Stephen L. Blau

[57] ABSTRACT

A head for a golf club iron is disclosed that provides a top planar surface which is substantially uniform width from toe to heel and shall support an indicia perpendicular to the longitudinal axis and parallel to the intended path of the ball. The indicia and the planar striking surface of the club face define an angle between them equal to the preselected loft angle for the planar striking surface plus 90°, and such a relationship holds true for each club in a set. When the club is in the correct address position, such a relationship shall provide the golfer with dual axial alignment to insure the planar striking surface is perpendicular to the intended target line of the ball and the loft angle of the planar striking surface, with respect to the ball, matches the preselected loft angle. The golfer will use the indicia as a sighting aid when addressing the ball, so the club head may be adjusted to ensure correct direction and loft.

3 Claims, 3 Drawing Sheets

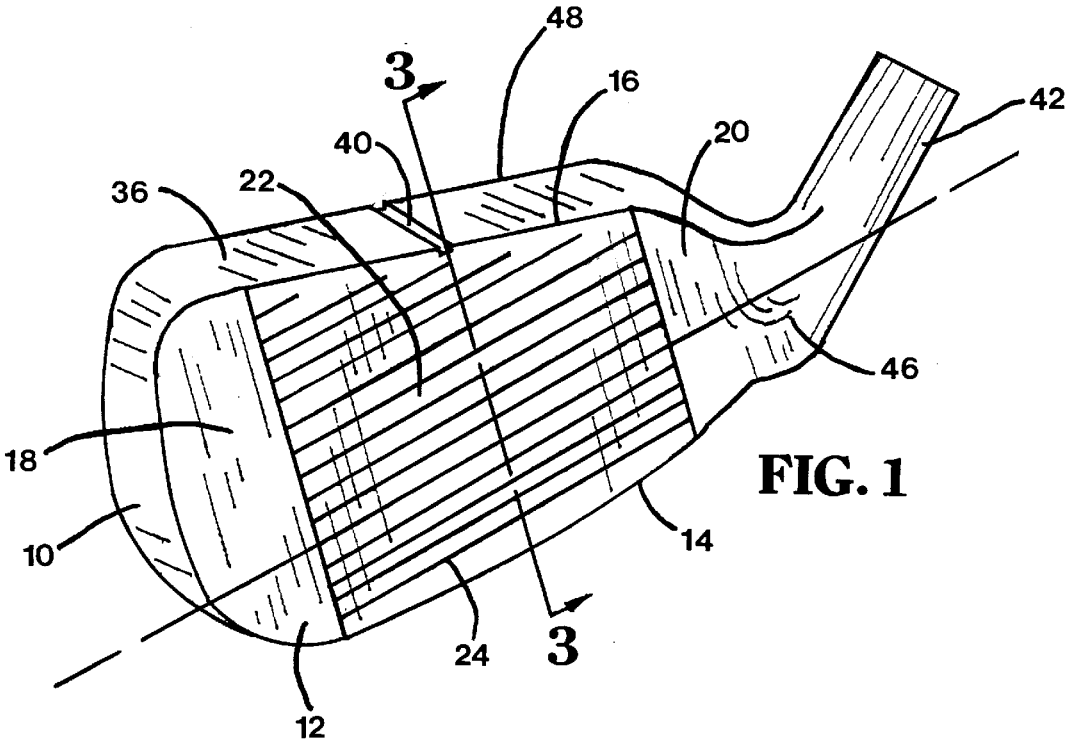
FIG. 1
FIG. 2
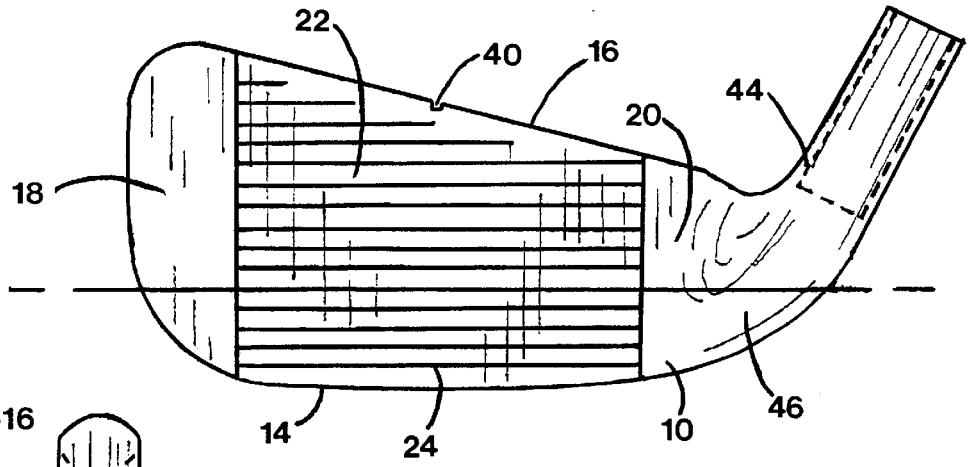
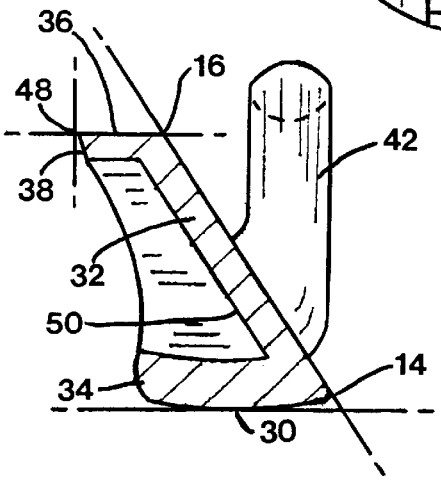
FIG. 3

FIG.4
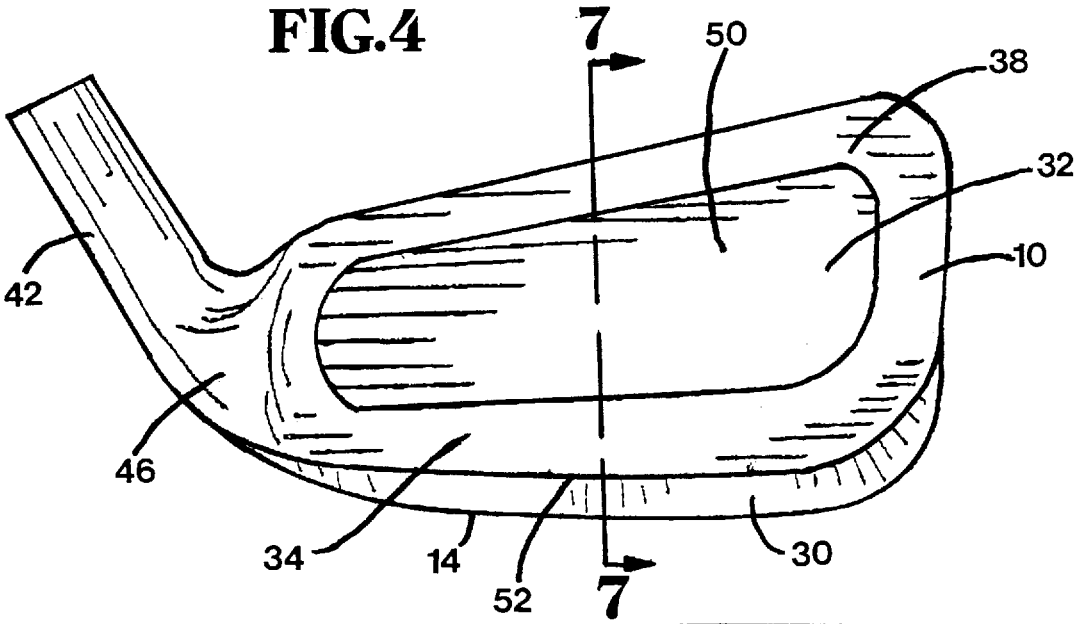
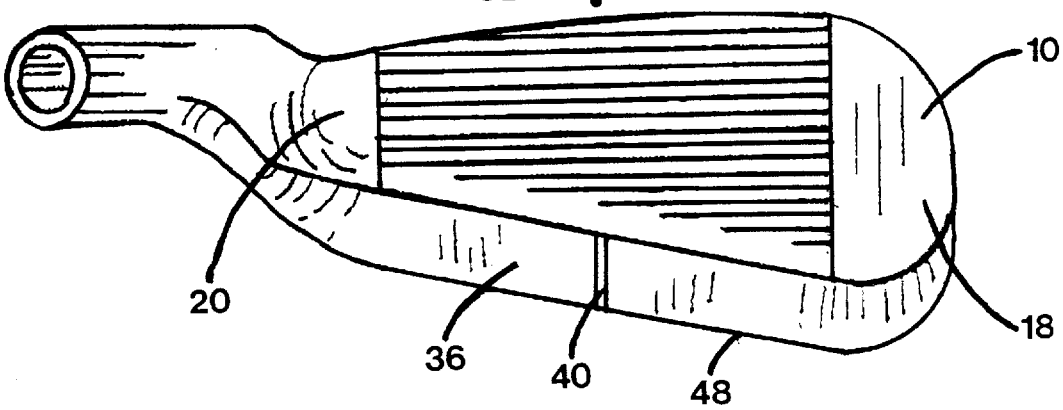
FIG.5

ADVANCED TOP PLANE FOR STANDARD IRON

CROSS-REFERENCE TO RELATED APPLICATIONS

U.S. Pat. No. 4,211,416 Jul. 08, 1980 Swanson

U.S. Pat. No. 4,345,763 Aug. 24, 1982 Swanson

U.S. Pat. No. 4,900,028 Feb. 13, 1990 Antonious

STATEMENT REGARDING FEDERALLY SPONSORED RESEARCH OR DEVELOPMENT

Not applicable

REFERENCE TO A MICORFICHE APPENDIX

Not applicable

FIELD OF THE INVENTION

This invention relates to golf club irons. More specifically, this invention relates to improvements in the design of golf club irons to increase the accuracy and finesse with which a golf ball is hit and placed on the course.

BACKGROUND OF THE INVENTION

Irons usually come in a set numbered 1 through 9 where the numbers refer to the club loft angle. The higher the number, the greater the loft angle. Irons 1 through 9 typically have loft angles of from 16° to 47° progressing from 1 through 9. A set of irons can also include a pitching wedge, gap wedge, sand wedge, and lob wedge. Wedges may have loft angles of from about 48° to 66°.

Golf is basically a target game. A number of modifications have been proposed to the basic club design to decrease the number of strokes required to transport the ball from the teeing ground to the hole in the green. Many ideas have been proposed to increase the accuracy of irons. A plethora of patents have been issued in the golf club art over a number of years relating to changes in the design of irons to improve alignment in the address position.

For example, Swanson U.S. Pat. No. 4,211,416 proposes a golf club iron that has the top surface of the head at an angle to the bottom surface in the face plane of the club in which the toe of the club flares upwardly and outwardly at an angel to the bottom edge defined by the sole and face when viewed from the address position. The head is provided with a flange or ledge projecting rearwardly from the top edge of the head, extending substantially along the entire length from toe to heal to define a rear sighting edge. The rear sighting edge is parallel with the bottom front edge of the golf club head. The sighting edge is said to permit the golfer to align the face normal to the intended flight path of the ball when the bottom edge of the head is obscured by turf.

Swanson U.S. Pat. No. 4,345,763 discloses a thin sighting line for lofted golfing irons of the type referred to in Swanson U.S. Pat. No. 4,211,416, but is said to eliminate the rearwardly extending ledge. The Swanson'763 patent discloses a sighting edge formed along the topmost portion of a golf club head of substantially rectangular configuration. The club of the Swanson'763 patent is said to have a top edge that is thin and provides a true sight line when addressing the ball that is not obscured by the back face of the club.

The back of the head of the club disclosed in the Swanson'763 patent extends vertically from the back bottom edge of the thick sole to a ridge that is inclined from near the top of the toe to a level about flush with the top end of the hosel at the heel. The hosel is connected by a flattened wide land to the lower portion of the heel. In one embodiment, a rounded bevel or fillet merges the ridge into a thin top portion of the club head. With the rectangular configuration of the club face, the thin top edge is said to be parallel to the bottom edge of the club defined by the intersection of the face and the sole of the club.

The Swanson clubs are not perimeter weighted clubs. The club of the '763 patent has been criticized as non-traditional in shape, weight distribution, and strike ability characteristics. The Antonious U.S. Pat. No. 4,900,028 discloses a golf club head of non-standard shape having a diverging angular top ridge that extends upwardly and outwardly from the hosel toward the toe of the golf club head. A sighting section is included on the upper portion of the top ridge that is perpendicular to the intended flight path of the ball and is parallel to the longitudinal axis between the heel and toe of the club face. The upper toe portion of the club head is substantially parallel to the sole of the club head and is therefore substantially horizontal to the ground when the club head is addressed to the ball.

As is apparent from the extent of the golf club art, slight modifications in club head design can produce significant changes in the use of the clubs and in accuracy and hitting distance. New materials for golf club heads, shafts, and balls can have a tremendous impact on whether one club design is preferred above another. Despite the plethora of current club designs and changes in materials that have occurred over the years, many golfers still have difficulty perfecting their aim and using their golf clubs to their best ability.

SUMMARY OF THE INVENTION

This invention is a head for a golf club iron having a new design that provides for greater accuracy and control of direction and loft. The invention provides a golf club iron having a lofted planar striking surface of standard shape with a top planar surface of substantially uniform width extending from toe to heel. The top planar surface intersects the back surface and supports an indicia such as a groove or plurality of grooves for sighting which extend from the top edge of the striking surface to the top edge of the back surface. This top planar indicia is perpendicular to the horizontal score lines of the striking surface, and forms an angle with the striking surface equal to the loft of the individual iron plus 90°, and thus varies respectively with each iron of the set. The combination of the top planar surface and the indicia prove useful for dual axial alignment of the club head in the address position for controlling direction and loft, in a club having a traditional and standard shaped striking surface.

BRIEF DESCRIPTION OF THE DRAWINGS

Some of the features and advantages of the invention have been stated. Other advantages will become apparent as the description of the invention proceeds taking into conjunction the accompanying drawing, in which:

FIG. 1 illustrates a front perspective view of a head for a golf club iron of the invention;

FIG. 2 illustrates a front plan view of the club head;

FIG. 3 illustrates a transverse section through the club head taken along line 3—3 of FIG. 1;

FIG. 4 illustrates a plan view of the back surface of the club head of the invention;

FIG. 5 illustrates a top plan view of the club head;

DETAILED DESCRIPTION OF THE DRAWINGS

Figure 6:
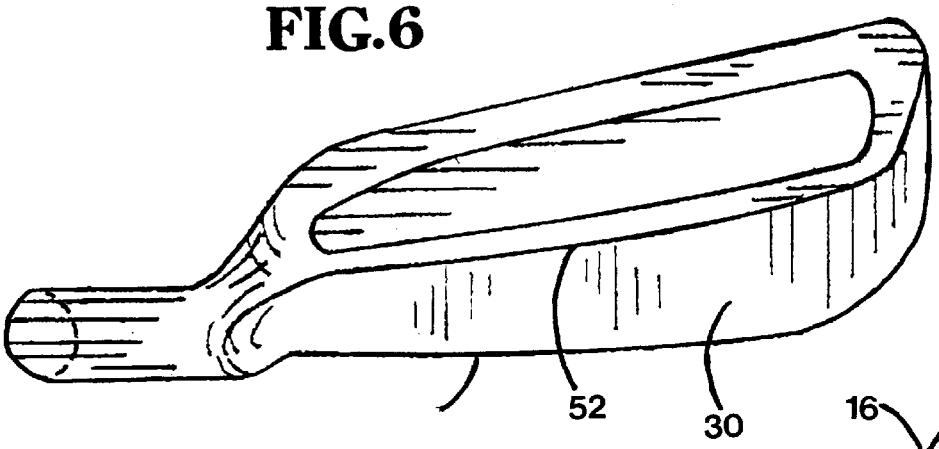
FIG. 6 illustrates a bottom plan view of the club head.

The invention will now be described more fully with reference to the accompanying drawings, which illustrate a preferred embodiment of the invention.

Illustrated in FIG. 1 is a perspective front view of a head 10 for a golf club iron in accordance with the invention. The golf club head has a sloped-back club face 12 having a leading bottom edge 14, a trailing top edge 16, and toe and heal portions 18 and 20, respectively, in which 18 is of greater height in joining the bottom and top edges. The sloped-back club face has a preselected loft angle, which is the angle of the slope of the club face back from the vertical. The club in FIG. 1 has a loft angle of approximately 34°, which would typically be designated a seven iron.

The bottom edge, trailing top edge, and toe and heel portions define a planar striking surface 22 of substantially standard configuration. The planar striking surface has a plurality of parallel grooves 24 in the club face for imparting the desired spin to the golf ball. These grooves typically are painted in contrasting color front he club face so as to be more easily discernible and to provide a pleasing appearance. The striking surface may also be etched to have a frosted appearance.

A sole 30 extends rearwardly from the leading bottom edge 14 of the club face, as also shown in FIGS. 3, 4, 6, and 7. The sole extends rearwardly from the leading bottom edge 14 of the club face and intersects the back surface 32 of the club at a lower portion thereof 34. As shown in FIG. 6, the sole becomes progressively wider from heel to toe.

The sole typically is curved in the longitudinal and transverse directions to facilitate movement of the club through grass in the manner of premium clubs. The sole shown in FIG. 2 is curved about 240° along the arc of a circle in the longitudinal direction. Typically, the sole can be curved longitudinally along the arc of a circle of less than about 130° to 250° or more. The sole shown in FIG. 3 is curved transversely from front to back along the arc of a circle of about 60°.

The club head also includes a top planar surface 36 of substantially uniform width that extends from toe to heel. The top planar surface extends rearwardly from the trailing top edge 16 of the sloped-back club face 22 and intersects the back surface at an upper portion 38 of the back surface forming the rear edge of the top planar surface 48.

Figure 7:
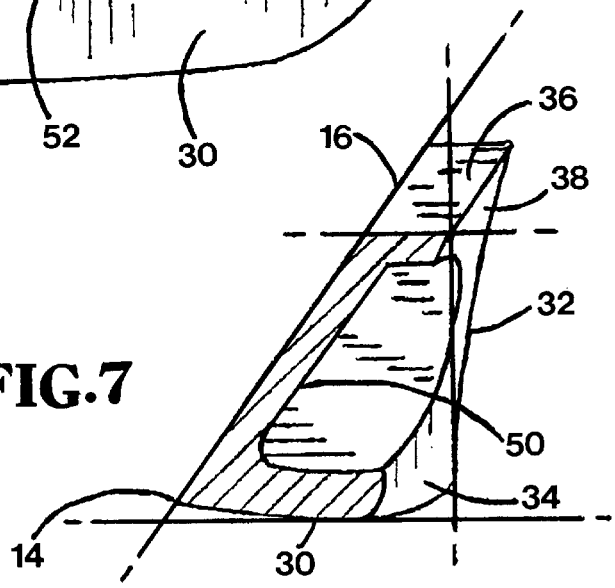
FIG. 7 illustrates a transverse section through the club head taken along line 7—7 of FIG. 4 and in the opposite direction along the longitudinal axis of the section illustrated in FIG. 3.

The top planar surface 36 and the planar striking surface 22 define an angle between them such that the top planar surface 36 supports an indicia 40, which is perpendicular to the grooves of the striking surface 24 and the longitudinal axis, and defines an angle with the striking surface 22 that is equal to the preselected loft angle for the planar striking surface plus 90°, as shown in FIGS. 3 and 7. Such a relationship between the indicia 40 and the striking surface 22 does not allow for an angle of loft plus 90° to be defined between the top planar surface 36 and the striking surface 22 on a standard shaped iron in which the toe portion 18 is of greater height than the heal portion 20, thus such an angle may vary from iron to iron depending on the relative heights of the toe portion 18 and the heel portion 20.

The preselected loft angle corresponds to the club face planar striking surface and will vary with each iron of the set. The preselected loft angle typically will vary from about 10° for a "zero lofted iron" iron to about 66° for a lob wedge having a high degree of loft.

The golf club head also has a hosel 42 extending from the heel. The sole, heel, club face, and back surface of the club all come together to form a smooth transition into the hosel. The hosel is that portion of the golf club head that comprises a socket into which a golf club shaft may be inserted. As shown in FIG. 1, 2, and 3, the hosel extends upwardly and outwardly from the heel adjacent the sole 30 and forward from the planar striking surface 22. The acute angle between the longitudinal axis through the hosel and a vertical axis through the club head from top to bottom defines the angle of the lie of the club from toe to heel when the club is in the address position.

The hosel 42 also extends forward from the planar striking surface 22 at an angle to the planar striking surface as is shown in FIG. 3. In the case of the seven iron illustrated in FIG. 5 and 6, the hosel is offset from the club face and is in front of the leading bottom edge 14 by a distance of about 1.5 mm. The hosel comprises an upper, substantially cylindrical socket 44 for receiving the golf club shaft and a lower transition region 46 whereby the hosel is joined to the heel and sole.

The plane of the top planar surface 36 is shown in FIGS. 1, 5, and 7. The plane extends from toe to heel and from the trailing top edge 16 to the rear edge of the top planar surface 48. As shown in FIG. 3, when the club is held in the correct address position, the top planar surface 36 shall support an indicia 40 or plurality of indicia, such as a groove, which is perpendicular to the grooves 24 in the face and the longitudinal axis, and defines an angle with the striking surface 22 that is equal to the preselected loft angle for the planar striking surface plus 90°. This arrangement provides for the indicia to be parallel to the intended line of target and thus used by the golfer for aim and alignment.

The golf club as illustrated is a perimeter weighted club head. Perimeter weighted clubs typically are cast and are made of stainless steel or other rigid material such as titanium. A perimeter weighted club has a mass of metal extended from the back surface thereof to provide favorable weight characteristics for the particular club.

Turning now to FIG. 4, the perimeter weighted club head of the invention is shown with upper and lower portions 38 and 34, respectively, of a back surface. The upper and lower portions of the back surface of the club define a cavity 50 there between, as shown also in FIGS. 3 and 7. The back surface lower portion intersects with the rearwardly extended sole and defines an edge 52 between them.

The back surface lower portion 34 is a peripheral weighted portion that becomes progressively thicker from the heel to the toe. As shown in FIG. 6, the sole 30 progressively becomes wider from heel to toe and the back surface lower portion 34 provides substantial peripheral weight progressing from the heel to the toe. The back surface defined by the cavity can bear printed indicia such as trademarks or other information concerning the golf club.

The foregoing description is to be considered illustrative rather than restrictive of the invention. While this invention has been described in relation to its specific embodiments, it is to be understood that various modifications thereof will be apparent to those of ordinary skill in the art upon reading the specification and it is intended to cover all such modifications that come within the meaning and range of equivalence of the appended claim.

What is claimed is:

1. A head for a golf club iron comprising:

a) a, sloped-back club face having a leading bottom edge, a trailing top edge, and toe and heel portions joining said bottom and top portions, such that the top portion increase in height from heel to toes;

b) a top planar surface of substantially uniform width extending from toe to heel and rearwardly from said trailing top edge; which supports an indicia perpendicular to the grooves on the face and longitudinal axis, and defines an angle with the striking surface equal to the preselected loft angle plus 90;

c) a sole extending rearwardly from said leading bottom edge of said club face;

d) a hosel extending upwardly and outwardly from said heel adjacent said sole and forward from said planar striking surface;

e) a preselected loft angle between 10 and 66 which corresponds to the club face planar striking surface selected from the group consisting of irons 1 through 9, a pitching wedge, a gap wedge, a sand wedge, and a lob wedge;

f) a rigid material such as stainless steel or titanium; and g) a perimeter weighted upper and lower portions of said back surface which define a cavity there between, and wherein said back surface lower portion that intersects said rearwardly extending sole and defines an edge there between is a peripheral weighted portion that progressively becomes thicker from heel to toe so that said sole progressively becomes wider from heel to toe and said back surface lower portion provides substantial peripheral weight progressing from said heel to said toe, and wherein said upper portion is of substantially uniform thickness from heel to toe so that said top planar surface is of substantially uniform width and wherein said upper portion overhangs said cavity.

2. The golf club head of claim 1 wherein said top planar surface of substantially uniform width supports an indicia perpendicular to the grooves on the face and longitudinal axis, and defines an angle with the striking surface equal to the preselected loft angle plus 90°, thus, when in the correct address position, the indicia shall be parallel to the intended target line of the ball and used by the golfer as a dual axial alignment sighting aid when addressing the ball, so the club head may be adjusted to ensure correct direction and loft.

3. A head for a golf club iron comprising a, sloped-back club face having a leading bottom edge, a trailing top edge, and toe and heel portions joining said bottom and top portions such that the top portion increases in height from heel to toe, a top planar surface of substantially uniform width extending from toe to heel and rearwardly from said trailing top edge, a sole extending rearwardly from said leading bottom edge of said club face, a hosel extending upwardly and outwardly from said heel adjacent said sole and forward from said planar striking surface, a preselected loft angle between 10 and 66 which corresponds to the club face planar striking surface selected from the group consisting of irons 1 through 9, a pitching wedge, a gap wedge, a sand wedge, and a lob wedge, a rigid material such as stainless steel or titanium, a perimeter weighted upper and lower portions of said back surface which define a cavity there between, and wherein said back surface lower portion that intersects said rearwardly extending sole and defines an edge there between is a peripheral weighted portion that progressively becomes thicker from heel to toe so that said sole progressively becomes wider from heel to toe and said back surface lower portion provides substantial peripheral weight progressing from said heel to said toe, and wherein said upper portion is of substantially uniform thickness from heel to toe so that said top planar surface is of substantially uniform width and wherein said upper portion overhangs said cavity, and a top planar surface of substantially uniform width which supports an indicia perpendicular to the grooves on the face and longitudinal axis, and defines an angle with the striking surface equal to the preselected loft angle plus 90, thus, when in the correct address position, parallel to the intended target line of the ball and used by the golfer as a dual axial alignment sighting aid when addressing the ball, so the club head may be adjusted to ensure correct direction and loft.

* * * * *